US012359441B2

(12) United States Patent
Kumar

(10) Patent No.: US 12,359,441 B2
(45) Date of Patent: Jul. 15, 2025

(54) BUILDING CLADDING SYSTEMS AND METHODS OF USE THEREOF

(71) Applicant: Westlake Royal Building Products Inc., Houston, TX (US)

(72) Inventor: Amitabha Kumar, San Antonio, TX (US)

(73) Assignee: Westlake Royal Building Products Inc., Houston, TX (US)

( * ) Notice: Subject to any disclaimer, the term of this patent is extended or adjusted under 35 U.S.C. 154(b) by 63 days.

(21) Appl. No.: 17/842,560

(22) Filed: Jun. 16, 2022

(65) Prior Publication Data

US 2022/0403663 A1 Dec. 22, 2022

Related U.S. Application Data

(60) Provisional application No. 63/211,992, filed on Jun. 17, 2021.

(51) Int. Cl.
*E04F 13/08* (2006.01)
*E04F 13/14* (2006.01)

(52) U.S. Cl.
CPC ..... *E04F 13/0816* (2013.01); *E04F 13/147* (2013.01)

(58) Field of Classification Search
CPC . E04F 13/0816; E04F 13/147; E04F 13/0855; E04F 13/0862; E04F 2203/02; G09F 11/23; G09F 11/025; G09F 11/02
USPC ..... 40/503–507
See application file for complete search history.

(56) References Cited

U.S. PATENT DOCUMENTS 2,117,186 A * 5/1938 MacLaren ..... G09F 11/025 40/488
3,080,668 A * 3/1963 Reali ..... G09F 11/025 40/624
3,447,628 A * 6/1969 Shiflet ..... E04B 1/994 318/265
4,771,558 A * 9/1988 Roberts ..... G09F 11/025 40/505
7,428,791 B2 * 9/2008 Lyons ..... G09F 11/025 211/163
8,915,035 B2 * 12/2014 Shaffer ..... B32B 27/00 52/316
9,322,165 B2 * 4/2016 Luhtala ..... E04B 1/994
11,028,590 B1 6/2021 Boss et al.
(Continued)

OTHER PUBLICATIONS

"Rotating Curtain Panel," Revit: Down to the Details, Jun. 30, 2012, available at http://revitdowntothedetails.blogspot.com/2012/07/rotating-curtain-panel.html (3 pages).
(Continued)

*Primary Examiner* — Brian E Glessner
*Assistant Examiner* — Adam G Barlow
(74) *Attorney, Agent, or Firm* — Bookoff McAndrews, PLLC

(57) ABSTRACT

Building cladding systems with changeable appearances are described. The building cladding system may include a plurality of panels, a substrate, and a controller configured to move the plurality of panels relative to the substrate to change the appearance of the building cladding system, while protecting the substrate. Moving the plurality of panels to change the appearance of the building cladding system may include rotation.

20 Claims, 3 Drawing Sheets

(56) References Cited

U.S. PATENT DOCUMENTS

| | | | | |
|---|---|---|---|---|
| 2006/0108825 | A1* | 5/2006 | Petty | G09F 21/04 296/100.04 |
| 2010/0000134 | A1* | 1/2010 | MacKler | G09F 17/00 40/564 |
| 2014/0365017 | A1 | 12/2014 | Hanna et al. | |
| 2019/0292774 | A1* | 9/2019 | Durali | E04B 1/34321 |
| 2023/0265651 | A1* | 8/2023 | Molony | E04B 2/7453 52/506.09 |
| 2023/0340789 | A1* | 10/2023 | Norwood | E04F 13/0864 |
| 2023/0349166 | A1* | 11/2023 | Vézina | E04F 13/0894 |

OTHER PUBLICATIONS

"The Different Types of Backer Rod and Applications," Armacell.com, Nov. 10, 2017, available at https://www.armacell.us/blog/post/the-different-types-of-backer-rod-and-applications/(3 pages).

* cited by examiner

BUILDING CLADDING SYSTEMS AND METHODS OF USE THEREOF

CROSS-REFERENCE TO RELATED APPLICATION(S)

This application claims priority to U.S. Provisional Application No. 63/211,992 filed on Jun. 17, 2021, which is incorporated by reference herein in its entirety.

TECHNICAL FIELD

The present disclosure generally relates to a building cladding system with changeable appearances, and methods of use thereof.

BACKGROUND

Different building cladding may be used to change the external appearance of commercial or residential buildings. Exterior surfaces of the cladding are generally prepared with the desired aesthetic design, such as with paint or other additions or decoration to provide the desired design. The finished cladding surface on the building is permanent and the appearance of the building, or a portion of the building, can only be altered with significant effort and cost to replace the design. For instance, traditional means of altering the appearance of building cladding involve re-finishing or removing existing cladding.

SUMMARY

The present disclosure includes building cladding systems and methods of use thereof. For example, the present disclosure includes a building cladding system comprising a substrate; a plurality of panels coupled together and movable relative to the substrate; and a controller configured to move the plurality of panels from a first orientation relative to the substrate to a second orientation relative to the substrate. In the first orientation, the plurality of panels may form a first design, and in the second orientation, the plurality of panels form a second design different from the first design. Each panel may include two or more surfaces and each surface may comprise a design element. In at least one example, the movement from the first orientation to the second orientation may be a rotation, such as a rotation of 60° to 180°.

According to some examples herein, the first design or the second design may have an appearance of brick, stone, wood, or tile. In some examples, the first design may have a different color than the second design. According to some aspects, the first design may have a different texture than the second design. In some examples, a cross-section of each panel may be circular, triangular, square, rectangular, pentagonal, or hexagonal.

The controller may include a mechanism configured to rotate the plurality of panels mechanically, electronically, or by a combination thereof. In at least one aspect, the mechanism may include a chain and gear. Additionally or alternatively, the mechanism may include a motor, electronic components, and combinations thereof. Further, for example, the controller may include a sensor and a microprocessor, the microprocessor being configured to move the plurality of panels based on a parameter detected by the sensor. For example, the parameter detected by the sensor may be light, temperature, moisture, or a combination thereof.

In some embodiments, the plurality of panels may cover an entire surface of the substrate in each of the first orientation and the second orientation. For example, the plurality of panels may comprise wood, concrete, or polymer. In some examples, each panel may be solid or hollow.

The present disclosure also includes a method of using the above described building cladding system for changing an appearance of the building cladding system. The method may include rotating the plurality of panels from the first orientation to the second orientation with the controller. The method may further include rotating the plurality of panels from the second orientation to a third orientation, wherein in the third orientation, the plurality of panels form a third design different from each of the first design and the second design.

Further, for example, the present disclosure includes a building cladding system comprising a substrate, a plurality of panels coupled together and movable relative to the substrate, and a controller configured to rotate the plurality of panels from the first orientation to the second orientation. Each panel may be rotatable between a first orientation relative to the substrate to a second orientation relative to the substrate. For example, in the first orientation, the plurality of panels collectively may form a first design and in the second orientation, the plurality of panels may collectively form a second design different from the first design. The first design or the second design may have an appearance of brick, stone, wood, or tile, for example.

In some aspects, the controller may include a mechanism configured to rotate the plurality of panels mechanically, electronically, or by a combination thereof. For example, the controller may comprise a microprocessor configured to control rotation of the panels according to a predetermined algorithm stored in the controller. In some examples, rotation from the first orientation to the second orientation may be 60° to 180°.

BRIEF DESCRIPTION OF THE DRAWINGS

The accompanying drawings, which are incorporated in and constitute a part of this application, illustrate certain exemplary features of the present disclosure, and together with the description, serve to explain the principles of the present disclosure. Elements depicted in the figures are not necessarily drawn to scale. The dimensions of some features may be exaggerated relative to other features to improve understanding of exemplary embodiments. Those of ordinary skill in the art will readily recognize that the features of a particular aspect or embodiment may be used in conjunction with the features of any or all of the other aspects or embodiments described in this disclosure.

DETAILED DESCRIPTION

Figure 1:
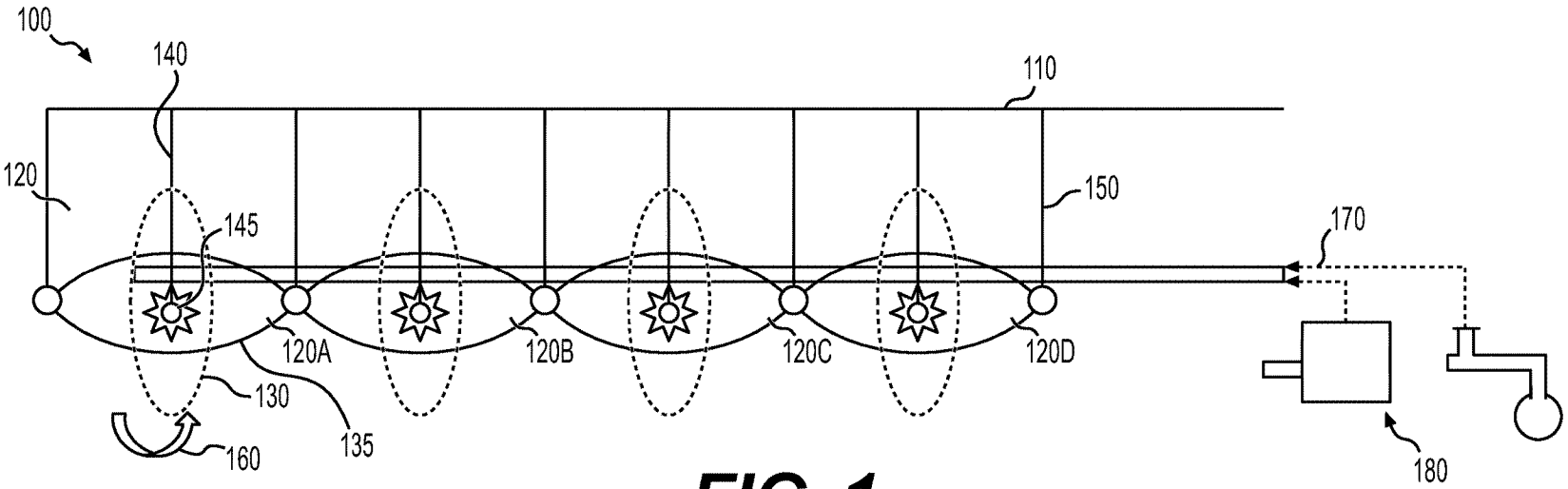
FIG. 1 illustrates an exemplary building cladding system comprising a plurality of panels according to some aspects of the present disclosure.

The singular forms "a," "an," and "the" include plural reference unless the context dictates otherwise. The terms "approximately" and "about" refer to being nearly the same as a referenced number or value. As used herein, the terms "approximately" and "about" generally should be understood to encompass ±5% of a specified amount or value. All ranges are understood to include endpoints, such as a rotation of 60° to 180° (or between 60° and 180°) includes 60°, 180°, and all values between.

The present disclosure generally includes building cladding systems. For example, the building cladding system may comprise a plurality of panels coupled together. For example, the panels may be moved in order to change the appearance of the building cladding system. For example, the panels may be rotated from one orientation that forms a color, design, or a combination thereof to another orientation that forms a different color, design, or combination thereof. The building cladding systems herein may comprise a substrate, the plurality of panels being movable relative to the substrate. In some examples, the plurality of panels cover an entire surface of the substrate in one or more orientations, or in each orientation. In some examples, the plurality of panels covers a portion of a substrate surface. The building cladding systems herein also may protect a substrate, such as a building, for example a residential, commercial or industrial building, from exposure to the environment. For example, the cladding may provide protection against natural elements such as wind, rain, sun, snow, heat, cold, fog and other environmental elements or conditions. Further, for example, the building cladding systems herein may provide security, insulation from heat, insulation from sound, protection from entry of light, or any combination thereof. Thus, the building cladding systems herein may be multifunctional, for example, providing structural/protective benefits in additional to aesthetic effects.

The substrate may comprise a natural material, a synthetic material, or a combination thereof. Exemplary substrates suitable for the present disclosure include, but are not limited to, wood, cement, concrete, and polymers (including polymer composites). In some examples, the substrate comprises a polymer composite that comprises an inorganic filler. For example, the polymer may comprise polyurethane. The polyurethane may be a polyurethane composite. The panels of the cladding systems herein may be designed to protect the substrate from environmental conditions as described above. For example, the substrate may be the exterior of a building, and the panels may be designed to protect the exterior of a building from various environmental conditions.

The panels of the building cladding systems herein may have any suitable shape that allows for movement relative to each other, movement relative to a substrate, or a combination thereof. For example, the shape of the panels may be polygonal or the panels may have an irregular shape. Exemplary polygonal shapes useful for the present disclosure include, but are not limited to, rectangular and triangular shapes. For example, the panels may have one or more curved surfaces, one or more angular surfaces, or combinations of curved surfaces and angular surfaces. The one or more curved surfaces may be elliptical or circular in cross-section. In some aspects of the present disclosure, the panels each have the same shape. In some examples herein, the cross-section of each panel may be circular, triangular, square, rectangular, pentagonal, or hexagonal. In other aspects, the building cladding system comprises panels of different shapes. For example, a first plurality of panels may have a first shape and a second plurality of panels may have a second shape different from the first shape.

The panels of the cladding systems may be designed to allow for changing the appearance of a structure while protecting the structure, wherein the structure may be a building. Thus, for example, the panels may have sufficient durability to allow for repeated exposure to environmental conditions over time, including for an extended period of time such as years. The panels may be configured to change orientation while protecting the underlying substrate, a structure to which the substrate is attached or otherwise coupled to, or both the substrate and structure to which the substrate is attached or otherwise coupled to. The panels may be solid or hollow. For example, the panels may be constructed from an aerated or foam material. In the case of solid panels, the interior of the panels may be made from the same material or different materials as the surfaces of the panels. Exemplary materials suitable for the panels include, but are not limited to, wood, fiber cement, and polymers. The panels herein may comprise a combination of materials. The panels may be formed from durable materials suitable for withstanding extended exposure to the environment. For example, the panel materials may provide a barrier to moisture, withstand changes in temperature, withstand physical impact of weather conditions, or combinations thereof. The physical impact may include, for example, sleet, snow, debris carried by the wind, or a combination thereof.

Each panel may include two or more surfaces, wherein each surface comprises a design element or a portion of a design element that together with other panels of the system forms a design. Exemplary designs of the systems herein include, but are not limited to, brick, stone, wood, and tile. According to some aspects, the design element(s) of each panel includes color, images, symbols, messages or other text, texture, variations in contour or topography, or a combination thereof. For example, the surfaces of the panels may comprise a multitude of colors ranging from white to black or any colors in between.

In at least one example, the surfaces of the panels may be designed to reflect, deflect, mitigate, or improve the impact of various environmental conditions or other events that may be either disruptive or conducive to the well-being or quality of a building, persons within a building, or materials within a building. Examples of the conditions or events that may be either disruptive or conducive to buildings and persons therein include, but are not limited to, heat, light, rain, snow, wind, sun, and sound. For example, surfaces of the panels of the building cladding systems herein may include materials that appear white or are closer to the white end (visible light) of the spectrum of light, which may cause radiation from the sun to be reflected. In such cases, the building cladding system may be beneficial for cooling on hot days. Further, in some examples, the panels may be moved to expose different surfaces of the panels having a darker color. Thus, on cold days, the darker color may be beneficial to retain heat by facilitating absorption of radiation from the sun. Such examples may promote energy efficiency and provide for energy savings.

In some examples, a combination of materials may be used on the surfaces of the panels to provide different designs. For example, one surface of each panel may comprise wood or have the appearance of wood, a second surface may comprise a composite material, and a third surface may comprise brick or have the appearance of brick. In at least one example, the composite material may comprise a polymer composite. Using a combination of materials on the surfaces of the panels provides the opportunity to change the designs, combine different designs for a unique and proprietary look, or a combination thereof.

The panels may be arranged relative to each other to allow for the panels to rotate together relative to the substrate. For example, each panel may be rotatable about a longitudinal axis of the respective panel. The building cladding systems herein may include a suitable mechanism for effectuating coordinated movement of the panels to change the appearance of the building cladding systems. Such mechanisms may be configured to accept user input and transmit the user input to the panels to move the panels. The mechanism may be mechanical, electronic, or a combination thereof.

For example, the building cladding systems herein may comprise a controller configured to move the plurality of panels from one orientation relative to the substrate to another orientation relative to the substrate. In some aspects of the present disclosure, the controller may be configured to rotate the plurality of panels from a first orientation relative to the substrate to a second orientation relative to the substrate. Thus, for example, the controller may include a mechanism configured to rotate the plurality of panels mechanically or electronically. For example, the mechanism may include one or more mechanical actuators coupled to the panels that are capable of rotating or otherwise moving the panels in a controlled manner. In some examples wherein the mechanism is mechanical, the rotation of the panels may be controlled with a lever or a set of levers. In other examples, the mechanism may include a chain and gear or a rack and gear. For such controllers, when the gear is turned, the chain or rack may be moved to a new position, exposing a new surface of each panel of the building cladding system. For example, a chain and gear may be attached to multiple panels to rotate them simultaneously or sequentially. In some examples, a cord or wire may be coupled to the gear and used to rotate the plurality of panels simultaneously. In some aspects, the controller comprises a linkage mechanism, wherein the plurality of panels of the building cladding system are coupled or linked together. When one panel of the system is moved by the controller, the other panels linked to that panel also may move. In some examples, the mechanism may include a motor.

According to some aspects, the mechanism includes a controller with a microprocessor configured to control rotation, other movement of the panels, or a combination thereof, according to a predetermined algorithm. For example, the controller may include suitable electronic components such as an integrated circuit, memory, transmitter, or combination thereof suitable for receiving user input and initiating instructions according to an algorithm stored in the controller for controlling movement of the panels. The controller may include a printed circuit board to support and electrically connect such components.

The controllers herein may comprise both mechanical components and electronic components. For example, the controller may comprise a motor and a circuit coupled to or otherwise in communication with the motor to move, in turn, a lever or set of levers coupled to the panels. The controller may comprise other electronic components such as a microprocessor.

In some aspects of the present disclosure, the controller may be configured to rotate or otherwise move the plurality of panels based on a parameter detected by a sensor, such as according to a predetermined algorithm stored in memory of the controller. Thus, for example, the controller may include a sensor or otherwise be in communication with a sensor in order to receive input from the sensor and initiate instructions according to an algorithm stored in the controller for controlling movement of the panels. The sensor may be configured to detect, for example, changes in light, temperature, moisture, or a combination thereof.

As mentioned above, each orientation of the plurality of panels may form a different design. For example, in a first orientation, the plurality of panels form a first design, and in a second orientation, the plurality of panels form a second design that is different from the first design. In some examples, the plurality of panels cover an entire surface of the substrate in each of the first orientation and the second orientation. Transition from one orientation to another may include rotating the panels between 0° and 360° in sequence or simultaneously. For example, the rotating from a first orientation to a second orientation may be at least 10°, at least 30°, at least 45°, at least 60°, at least 90°, at least 120°, or at least 150°. In some examples, rotation from a first orientation relative to the substrate to a second orientation relative to the substrate may be 60° to 180° or 45° to 90°. In at least one example, the panels may be rotated by 180° from a first orientation relative to the substrate to a second orientation relative to substrate, so as to flip the panels, either in the vertical direction or the horizontal direction. Transition from one orientation to another orientation may also include sliding the panels, horizontally, vertically, or in a transverse direction.

FIG. 1 illustrates an exemplary cladding system 100 in accordance with some aspects of the present disclosure. The cladding system 100 as shown in FIG. 1 illustrates a plurality of panels 120A, 120B, 120C, and 120D coupled together to form a cladding 120, which is coupled to a substrate 110. The substrate 110 may be, for example, the exterior of a building. Four panels (120A, 120B, 120C, and 120D) are shown in this example for illustration purposes, but it is understood that fewer or more panels could be used in such systems. Each panel from the plurality of panels may be rotatable. For example, each panel 120A-120D may have an first orientation (see position 135 of panels depicted in solid lines) and may be rotatable about its axis to change between orientations into a second orientation (see position 130 of panels depicted in dashed lines after rotating) and thereby change the surfaces of the panels that are visible from the outside of the building. Rotation is depicted by arrow 160.

FIG. 1 also depicts rods 140, 150 coupled to the cladding 120. One or more rods 140, 150 may be coupled to each panel. Illustrated in FIG. 1 are nine rods, including four rods 140 each coupled to a mechanism for moving the cladding, wherein rods 140 alternate with rods 150. FIG. 1 depicts a rod 140 coupled to each of the four panels 120A, 120B, 120C, and 120D. Each rod 140 is coupled to a respective gear 145 of a controller for rotating the panels, and each rod 140 also couples one of the respective panels 120A, 120B, 120C, and 120D to substrate 110. That is, the controller for this exemplary system includes the gears, as well as a motor, a crank for moving, or a combination thereof. For example, the controller may be used for rotating the panels. A rod 150 extends down between the panels of building cladding 120 and at opposite ends of the building cladding 120. Each rod 150 contacts an end portion of one or two of the four panels 120A, 120B, 120C, and 120D, wherein the rods 150 include respective seals to inhibit or prevent ingress of environmental elements or other foreign elements into the building cladding system 100. The cladding system 100 also includes a bar 170 to rotate the gears 145 of the mechanism via the crank, motor, or both. Additionally or alternatively, the system 100 may comprise a digital circuit 180 to manipulate/control the motor. The shape of the panels 120A-120D may be elliptical or circular in cross-section, wherein all panels 120A-120D are configured to rotate simultaneously. The panels in this example may be configured to inhibit or prevent forward movement.

Figure 2:
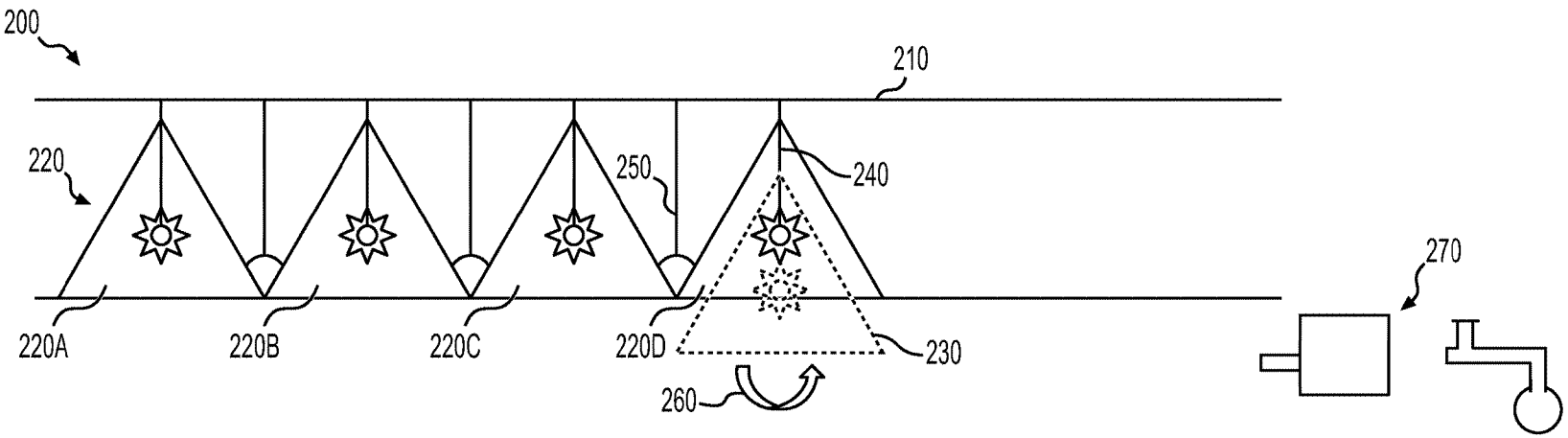
FIG. 2 illustrates an exemplary building cladding system comprising a substrate and a plurality of panels according to some aspects of the present disclosure.

FIG. 2 illustrates another exemplary cladding system 200 comprising a substrate 210 and plurality of panels 220A, 220B, 220C, and 220D coupled together forming the cladding 220. The substrate 210 may be a building, for example. The cladding 220 may be coupled to the exterior of the building or other substrate 210.

Additional features are similar to those shown in FIG. 1, however, this example includes an extendable rod 240 with a spring to push the cladding 220 forward for rotation to change the orientation of the cladding 220 and expose different surfaces of the panels 220A-22D to change the appearance of the cladding 220. The dashed line for panel 220D shows a position 230 after panel 220D has been pushed forward relative to its original position (shown in solid lines). After being pushed forward, the panels may rotate, where rotation is depicted in FIG. 2 by arrow 260, for example rotation about an axis that includes rod 240. The rotation mechanism may include a motor or crank 270, similar to the example of FIG. 1. The panels 220A-220D in this example may be configured to allow for forward movement. The forward movement is facilitated by each of the four rods 240. A rod 250 extends down between each of the panels 220A-220D of cladding 220. Each rod 250 includes a seal to inhibit or prevent ingress of elements into the cladding system 200. FIG. 2 depicts three rods 150.

Figure 3A:
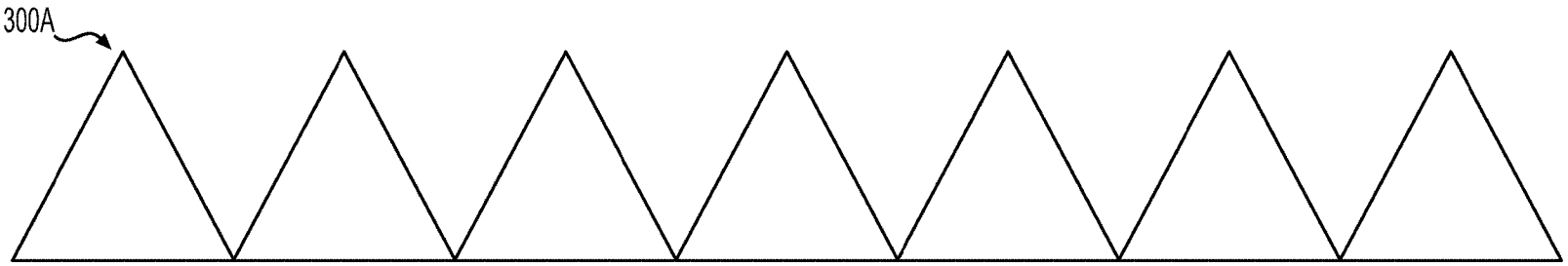
FIGS. 3A-3F illustrate cross-sections of exemplary panels of building cladding systems according to some aspects of the present disclosure.
Figure 3B:
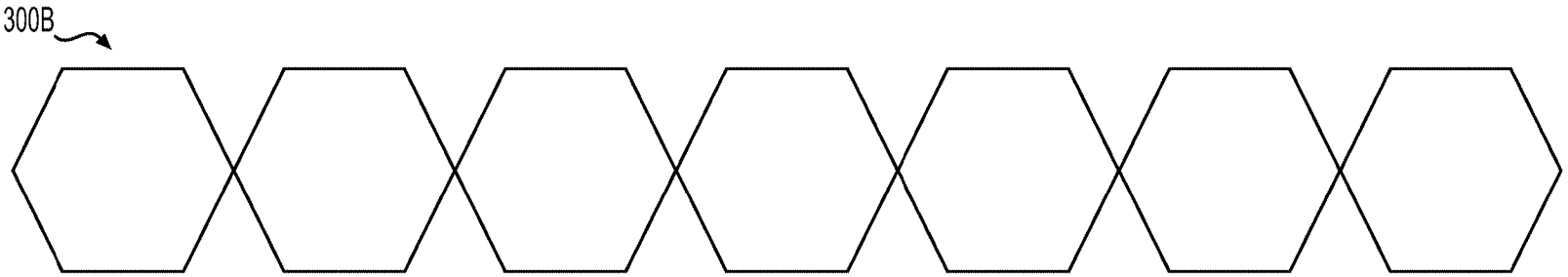
Figure 3C:
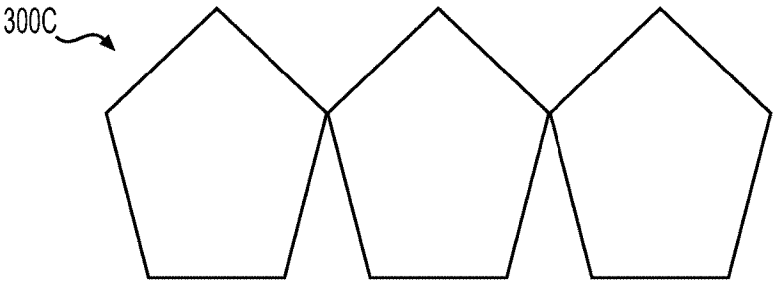
Figure 3D:
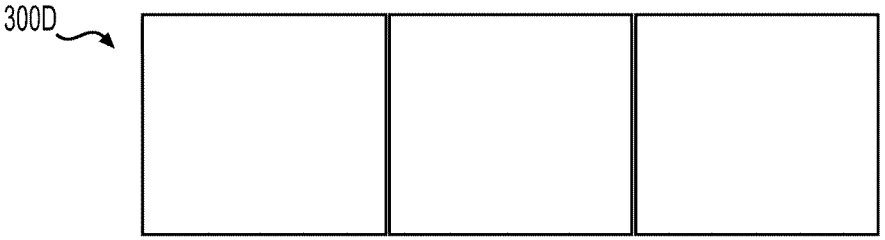
Figure 3E:
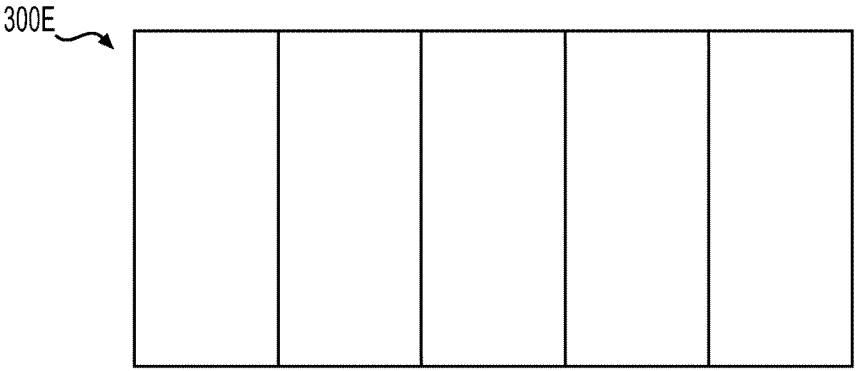
Figure 3F:
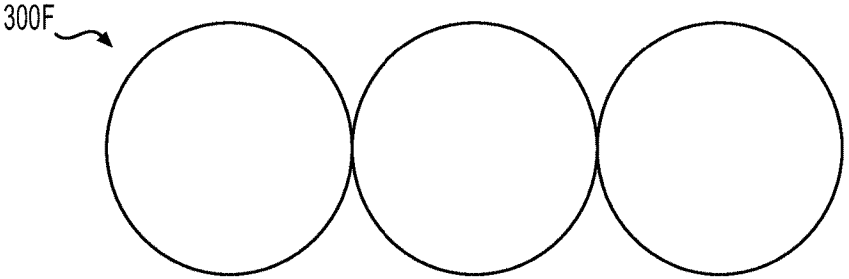

FIGS. 3A-3F illustrate cross-sectional shapes 300 for panels of building cladding systems according to some aspects of the present disclosure, including triangular (FIG. 3A), hexagonal (FIG. 3B), pentagonal (FIG. 3C), square (FIG. 3D), rectangular (FIG. 3E), and circular (FIG. 3F).

In some examples, each panel of the building cladding system includes at least two surfaces opposite each other. A first surface of each panel includes a common design element, while the opposing second surface of each panel includes a different common design element. For example, the first surface of each panel may be a first color, and the opposing second surface of each panel may be a second color. Rotating the panels between a first orientation in which the first surfaces face outward and a second orientation in which the second surfaces face outward changes the appearance (in this case, the color) of the building cladding system. While the above discussion refers to two surfaces, each panel may include more than two surfaces, such as three surfaces, four surfaces, or other multiple surface configurations. Each surface may include edges that intersect at various angles.

Systems and methods described herein provide a means to modify the appearance of a building, a portion of a building, building cladding, or other feature of the building. While most building materials, systems, and methods described herein relate to modifying the appearance of an exterior substrate (such as an exterior portion of a building or an exterior surface of building cladding), the building materials, systems, and methods described herein may also relate to modifying the appearance of an interior substrate (such as an interior portion of a building). For example, it is envisioned that the systems and methods described herein may be used to modify the interior of a living space, such as flooring.

Embodiments of the present disclosure are also envisioned wherein the surfaces of the plurality of panels of the building cladding system are configured to reflect infrared radiation to maintain a cool interior. Other embodiments are envisioned wherein the surfaces of the plurality of panels of the building cladding system are configured to capture energy from light sources and to convert the captured energy into heat, electricity, or a combination thereof. The source of light may be the sun or an artificial source of light. The building cladding systems herein may be configured to protect the surfaces of a building. For example, building cladding systems herein may be manufactured with durable, weatherproof, or weather resistant materials. For example, the panels of the building cladding system may have at least partial overlap between panels to inhibit or prevent ingress of elements such as rain water, snow, air/wind, heat, or a combination thereof. The panels may be configured such that the overlap between panels are accommodated in the mechanism for changing the orientation of the panels, allowing for movement between orientations.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents that all fall in the scope of the aspects described herein. Accordingly, the present disclosure is not to be considered as limited by the foregoing description.

What is claimed is:

1. A building cladding system comprising:

a substrate;

a plurality of panels coupled together and movable relative to the substrate, the plurality of panels comprising wood, concrete, or a polymer, each panel including two or more surfaces, each surface comprising a design element; and a controller configured to move the plurality of panels from a first orientation relative to the substrate to a second orientation relative to the substrate;

wherein in the first orientation, the plurality of panels form a first design, and in the second orientation, the plurality of panels form a second design different from the first design; and wherein the plurality of panels are configured to protect the substrate from environmental conditions, the plurality of panels having at least partial overlap between panels and wherein a vertical rod extends between adjacent panels, the vertical rod including a seal to inhibit or prevent ingress of environmental elements.

2. The system of claim 1, wherein the first design or the second design has an appearance of brick, stone, wood, or tile.

3. The system of claim 1, wherein the first design has a different color than the second design.

4. The system of claim 1, wherein the first design has a different texture than the second design.

5. The system of claim 1, wherein a cross-section of each panel is circular, triangular, square, rectangular, pentagonal, or hexagonal.

6. The system of claim 1, wherein the controller includes a mechanism configured to rotate the plurality of panels mechanically or electronically.

7. The system of claim 6, wherein the mechanism includes a chain and gear.

8. The system of claim 6, wherein the mechanism includes a motor.

9. The system of claim 1, wherein the controller includes a sensor and a microprocessor, the microprocessor being configured to move the plurality of panels based on a parameter detected by the sensor.

10. The system of claim 9, wherein the parameter detected by the sensor is light, temperature, moisture, or a combination thereof.

11. The system of claim 1, wherein movement from the first orientation to the second orientation is a rotation.

12. The system of claim 1, wherein the plurality of panels cover an entire surface of the substrate in each of the first orientation and the second orientation.

13. The system of claim 1, wherein each panel is solid or hollow.

14. A building cladding system comprising:

a substrate;

a plurality of panels coupled together and movable relative to the substrate, each panel being rotatable between a first orientation relative to the substrate to a second orientation relative to the substrate and slidable relative to the substrate; and a controller configured to rotate the plurality of panels from the first orientation to the second orientation;

wherein in the first orientation, the plurality of panels collectively form a first design, and in the second orientation, the plurality of panels collectively form a second design different from the first design;

wherein the first design or the second design has an appearance of brick, stone, wood, or tile; and wherein the plurality of panels are configured to protect a surface of the substrate from environmental elements.

15. The system of claim 14, wherein the controller includes a mechanism configured to rotate the plurality of panels mechanically or electronically.

16. The system of claim 14, wherein the controller comprises a microprocessor configured to control rotation of the panels according to a predetermined algorithm stored in the controller.

17. The system of claim 14, wherein rotation from the first orientation to the second orientation is 60° to 180°.

18. A method of changing an appearance of the building cladding system of claim 1, the method comprising rotating the plurality of panels from the first orientation to the second orientation with the controller.

19. The method of claim 18, further comprising rotating the plurality of panels from the second orientation to a third orientation, wherein in the third orientation, the plurality of panels form a third design different from each of the first design and the second design.

20. The system of claim 1, wherein the two or more surfaces are configured to reflect infrared radiation to maintain a cool interior of the underlying substrate.

* * * * *